US009272529B2

(12) United States Patent
Shimomura et al.

(10) Patent No.: US 9,272,529 B2
(45) Date of Patent: Mar. 1, 2016

(54) INKJET PRINTER

(71) Applicant: RISO KAGAKU CORPORATION, Tokyo (JP)

(72) Inventors: Kenji Shimomura, Ibaraki (JP); Hiroshi Hayashi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/617,993

(22) Filed: Feb. 10, 2015

(65) Prior Publication Data

US 2015/0231878 A1 Aug. 20, 2015

(30) Foreign Application Priority Data

Feb. 14, 2014 (JP) ..... 2014-026394

(51) Int. Cl.
*B41J 2/21* (2006.01)
*B41J 11/00* (2006.01)

(52) U.S. Cl.
CPC *B41J 2/21* (2013.01); *B41J 2/2103* (2013.01); *B41J 2/2146* (2013.01); *B41J 11/009* (2013.01)

(58) Field of Classification Search
CPC ..... B41J 2/15; B41J 2/21
USPC ..... 347/43
See application file for complete search history.

(56) References Cited

U.S. PATENT DOCUMENTS

2014/0055516 A1* 2/2014 Ogura et al. ..... 347/15

FOREIGN PATENT DOCUMENTS

JP 2002-067282 3/2002

* cited by examiner

*Primary Examiner* — Julian Huffman
(74) *Attorney, Agent, or Firm* — Greenblum & Bernstein, P.L.C.

(57) ABSTRACT

An inkjet printer includes a transfer unit that transfers a paper, a print unit that has three or more nozzle rows aligned along a transfer direction of the paper, and a controller that ejects ink on the paper by controlling the print unit while transferring the paper by controlling the transfer unit. The most-upstream nozzle row of the nozzle row and the most-downstream nozzle row are capable of ejecting ink whose color has a lowest brightness among colors of ink to be used for printing. The controller selects the most-upstream nozzle row or the most-downstream nozzle row as a nozzle row for ejecting the ink whose color has a lowest brightness according to a type of the paper. According to the printer, it becomes possible to restrict contaminations on a printed media while also restricting degradation of print quality.

3 Claims, 6 Drawing Sheets

FIG. 3
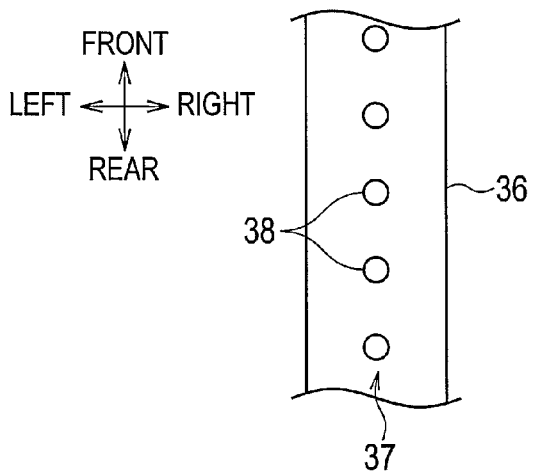
FIG. 4
81
| PAPER TYPE | EJECTION ORDER OF BLACK INK |
|---|---|
| PLAIN PAPER | FIRST |
| MATTE PAPER | LAST |
| ... | ... |
FIG. 5
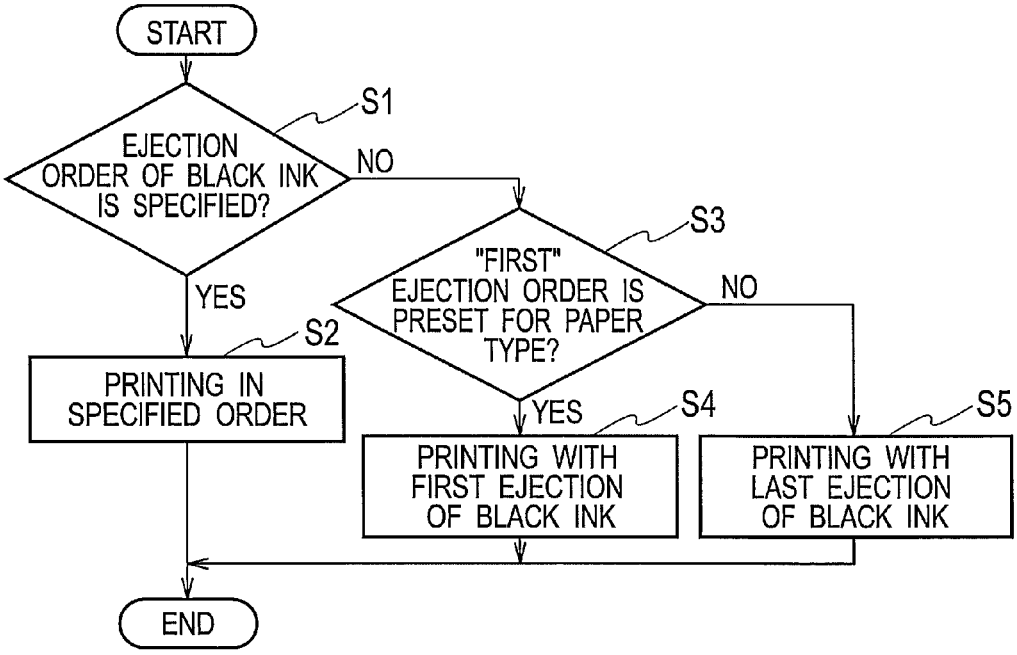

FIG. 7A
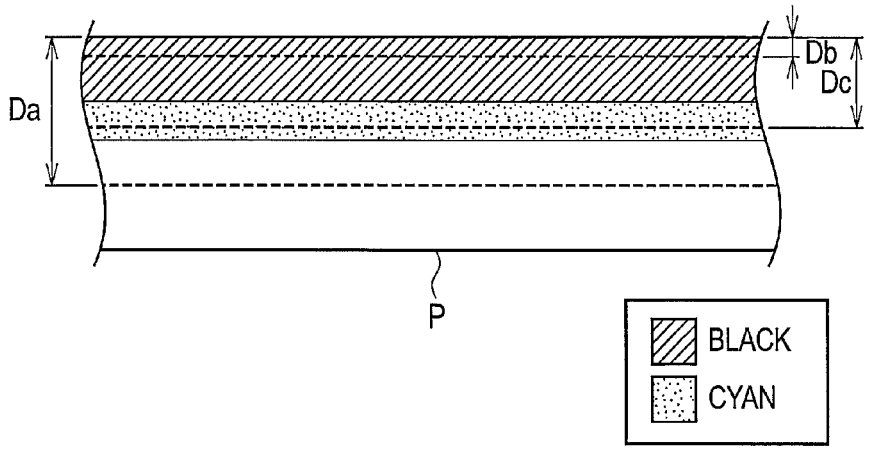
FIG. 7B
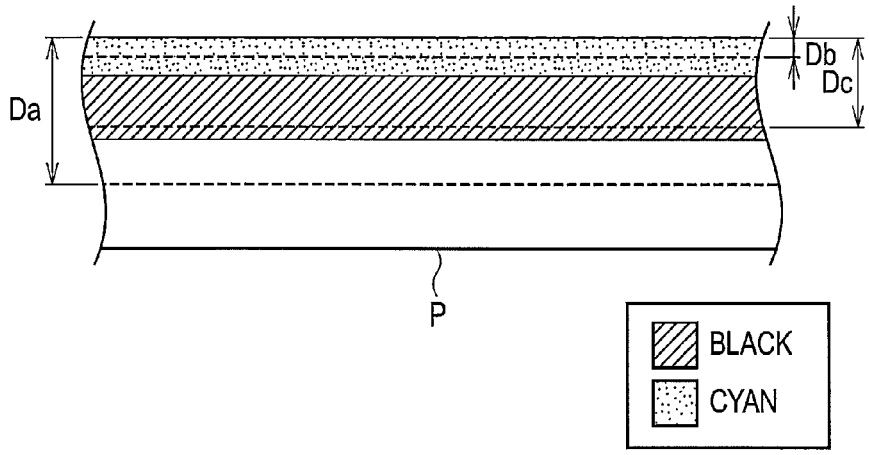
FIG. 8
| PAPER TYPE | EJECTION ORDER OF BLACK INK | OD VALUE | SMEAR CAUSED BY RUBBING |
|---|---|---|---|
| PLAIN PAPER | FIRST (K→C) | 1.1 | A |
| | LAST (C→K) | 1.06 | A |
| MATTE PAPER | FIRST (K→C) | 1.32 | D |
| | LAST (C→K) | 1.33 | C |

INKJET PRINTER

BACKGROUND OF THE INVENTION

1. Technical Field

The present invention relates to an inkjet printer.

2. Background Arts

As one of printing methods, inkjet printing is widely prevalent. In inkjet printing, images are formed by ejecting ink droplets from nozzles of inkjet heads onto a paper (e.g. Japanese Patent Application Publication No. 2002-67282).

An advantage of inkjet printing is that it can form images by simple processes, i.e. ejections of ink droplets onto a paper and their permeation into the paper. However, when printing is done with a plain paper having no coating by an inkjet printer, colors of a printed image may become dull and thereby its print quality may degrade due to ink bleed caused by ink permeability through fibers in the paper. On the other hand, when printing is done with a matte paper having a coating for example, degradation of its print quality can be restricted because more ink colorants remain near a surface of the paper than when printing is done with a plain paper.

SUMMARY OF THE INVENTION

However, in a printed media printed by an inkjet printer, smears caused by rubbing such as smears caused by a feed roller, smears caused by finger rubbing and so on may occur. Smears caused by a feed roller is contaminations on a printed media made by transferring of ink from a printed media to a feed roller that feeds the printed paper and further transferring of the ink from the feed roller to another/the print media. Smears caused by finger rubbing is contaminations on a printed media made by rubbing an area including a printed image by a finger and then rubbing a blank area by the finger on which ink adheres.

The more ink colorants remain near a surface of the paper, the more easily such smears caused by rubbing may occur. Namely, as described above, degradation of print quality may be restricted by using a matte paper than by using a plain paper, but smears caused by rubbing may occur more easily.

An object of the present invention is to provide an inkjet printer that can restrict contaminations on a printed media while also restricting degradation of print quality.

An aspect of the present invention provides an inkjet printer comprising: a transfer unit that transfers a paper; a print unit that has three or more nozzle rows aligned along a transfer direction of the paper, a most-upstream nozzle row of the nozzle row and a most-downstream nozzle row being capable of ejecting ink whose color has a lowest brightness among colors of ink to be used for printing; and a controller that ejects ink on the paper by controlling the print unit while transferring the paper by controlling the transfer unit, wherein the controller selects the most-upstream nozzle row or the most-downstream nozzle row as the nozzle row for ejecting the ink whose color has the lowest brightness according to a type of the paper.

According to the aspect, the controller selects the most-upstream nozzle row or the most-downstream nozzle row as the nozzle row for ejecting the ink whose color has the lowest brightness according to a type of the paper. Therefore, the inkjet printer can carry out printing in an adequate ejecting order of the ink whose color has the lowest brightness for restricting smears caused by rubbing while keeping good print quality. As a result, it becomes possible to restrict contaminations on a printed media while also restricting degradation of print quality.

BRIEF DESCRIPTION OF THE DRAWINGS

FIG. 3 is a bottom view of an inkjet head having nozzles;

FIG. 4 is a table showing an ejection order of black ink;

FIG. 5 is a flowchart for describing operations of the inkjet printer;

FIG. 7A is a schematic cross-sectional view showing ink permeability when black ink is ejected first on a matte paper;

FIG. 7B is a schematic cross-sectional view showing ink permeability when black ink is ejected last on a matte paper;

FIG. 8 is a table showing a test result for checking print density and smears caused by rubbing when black ink is ejected first/last onto a plain/matter paper;

DESCRIPTION OF THE EMBODIMENT

Figure 1:
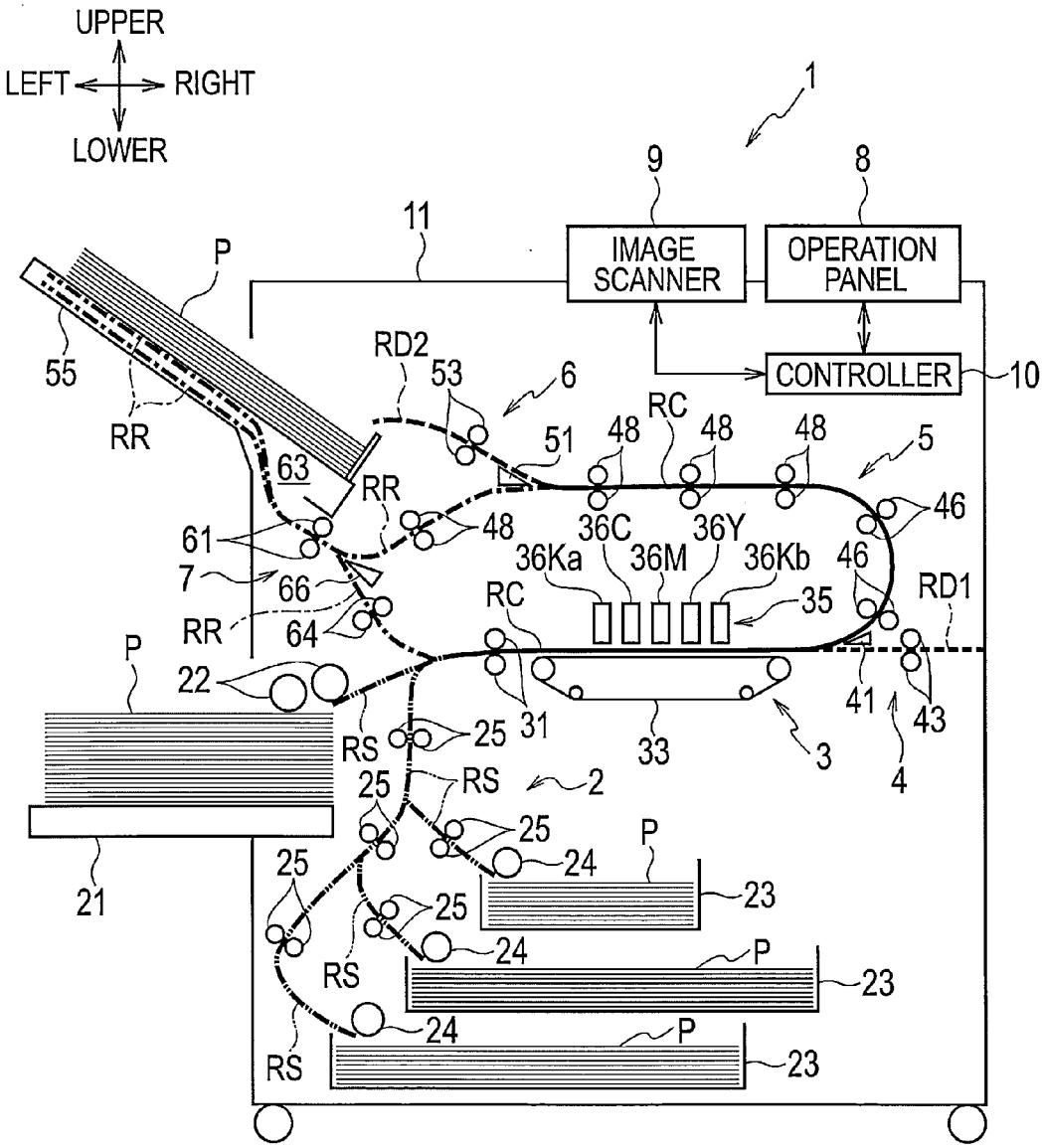
FIG. 1 is a schematic configuration diagram of an inkjet printer according to an embodiment.

Hereinafter, an embodiment will be described with reference to the drawings. In the drawings, identical or equivalent components to each other are indicated by an identical reference number. Note that the drawings show components schematically, and it should be understood that the components in the drawings may not be shown precisely as they are. In addition, actual dimensions of the components and actual dimensional proportions among the components may be shown differently in the drawings.

Further, the embodiment described below is shown as an example that specifically carries out the subject matter of the present invention. In addition, materials, shapes, structures, arrangements of the components are not limited to those in the embodiment. The embodiment may be modified within the scope of the claims (e.g. arrangement of the components may be changed from the embodiment).

In the following descriptions, your side with respect to FIG. 1 is denoted as front. A user may operate an inkjet printer 1 shown in FIG. 1 from its front side. In addition, upper, lower, left and right are also denoted by viewing from front.

Bold lines shown in FIG. 1 indicate transfer paths along which papers (print media) are transferred. Among the transfer paths, a normal path RC is indicated by a solid line, a switchback path RR is indicated by a dashed one-dotted line, a first ejection path RD1 is indicated by a dotted line, a second ejection path RD2 is indicated by a dashed line, and paper feed paths RS are indicated by dashed two-dotted lines. In following explanations, terms "upstream" and "downstream" mean upstream and downstream along the transfer paths.

Figure 2:
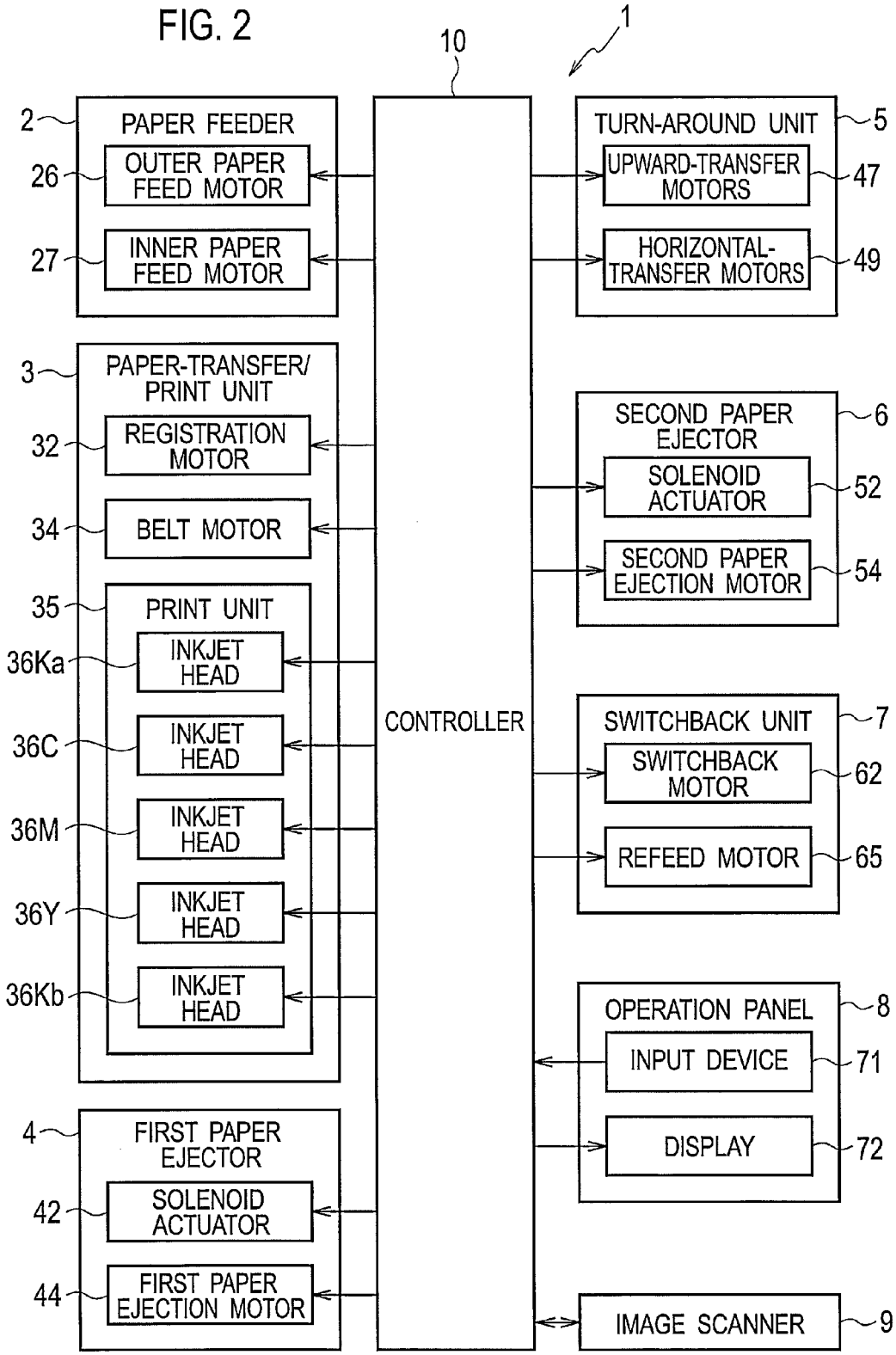
FIG. 2 is a block diagram of the inkjet printer.

As shown in FIG. 1 and FIG. 2, the inkjet printer 1 according to the present embodiment includes a paper feeder 2, a paper-transfer/print unit 3, a first paper ejector 4, a turn-around unit 5, a second paper ejector 6, a switchback unit 7, an operation panel 8, an image scanner 9, a controller 10, and a housing 11 that houses and supports the above components.

The paper feeder 2 feeds papers P. The paper feeder 2 is disposed at the most upstream side along the transfer paths. The paper feeder 2 includes an external paper feed tray 21, external paper feed rollers 22, internal paper feed trays (cassettes) 23, internal paper feed rollers 24, pairs of upward-feed rollers 25, an outer paper feed motor 26, and an inner paper feed motor 27.

On the external paper feed tray 21, papers P on which images are to be printed are stacked. The external paper feed tray 21 is provided in a state where it is partially protruded out from the housing 11.

The external paper feed rollers 22 pick papers P up from the external paper feed tray 21 sheet by sheet, and then feed them sequentially to a pair of registry rollers 31 to be described later along the uppermost paper feed path RS. The external paper feed rollers 22 are disposed above the external paper feed tray 21.

Also on the internal paper feed trays 23, papers P on which images are to be printed are stacked. The internal paper feed trays 23 are disposed within the housing 11.

Each of the internal paper feed rollers 24 picks papers P up from the correspondent internal paper feed tray 23 sheet by sheet, and then feed them sequentially to the paper feed path RS. Each of the internal paper feed rollers 24 is disposed above the correspondent internal paper feed tray 23.

Each pair of upward-feed rollers 25 sequentially feeds the papers P picked up from the correspondent internal paper feed tray 23 to the pair of registry rollers 31. Each pair of upward-feed rollers 25 is disposed along the correspondent paper feed path RS.

The outer paper feed motor 26 drives the external paper feed rollers 22 and the most-downstream pair of upward-feed rollers 25. The outer paper feed motor 26 is coupled with the external paper feed rollers 22 and the most-downstream pair of upward-feed rollers 25 via one-way clutches (not shown in the drawings), respectively. Therefore, the external paper feed rollers 22 are driven by rotations of the outer paper feed motor 26 in its one rotational direction, and the most-downstream pair of upward-feed rollers 25 is driven by rotations of the outer paper feed motor 26 in its another rotational direction.

The inner paper feed motor 27 drives the internal paper feed rollers 24 and the remaining pairs of upward-feed rollers 25 other than the most-downstream pair of upward-feed rollers 25. The inner paper feed motor 27 is coupled with the internal paper feed rollers 24 and the remaining pairs of upward-feed rollers 25 via clutches (not shown in the drawings), respectively. The clutches can decouple the inner paper feed motor 27 from the internal paper feed rollers 24 and the remaining pairs of upward-feed rollers 25 independently from each other. Therefore, the inner paper feed motor 27 can selectively drive the internal paper feed rollers 24 and the remaining pairs of upward-feed rollers 25.

The paper-transfer/print unit 3 prints images on papers P while transferring the papers P. The paper-transfer/print unit 3 is disposed downstream from the paper feeder 2. The paper-transfer/print unit 3 includes the pair of registry rollers 31, a registry motor 32, a belt transfer unit 33, a belt motor 34, and a print unit 35.

The pair of registry rollers 31 temporarily stops the paper P fed from the paper feeder 2 or the switchback unit 7, and then feed it to the belt transfer unit 33. The pair of registry rollers 31 is disposed on the normal path RC nearby a confluent point of the paper feed path RS and the switchback path RR. The pair of registry rollers 31 corresponds to a portion of a transfer unit defined in Claims. The registry motor 32 drives the pair of registry rollers 31.

The belt transfer unit 33 transfers the paper P transferred from the pair of registry rollers 31 while suctioning the paper P onto its endless platen belt. The belt transfer unit 33 is disposed downstream from the pair of registry rollers 31. The belt transfer unit 33 corresponds to a portion of the transfer unit defined in Claims. The belt motor 34 drives the belt transfer unit 33 to circulate the platen belt.

The print unit 35 includes inkjet heads 36Ka, 36C, 36M, 36Y and 36Kb. Note that the inkjet head 36Ka, 36C, 36M, 26Y or 36Kb may be referred as an inkjet head 36 without its suffix indicating its color (i.e. Ka, Kb, C, M and Y) when it is not needed to discern colors. The print unit 35 ejects ink droplets from its inkjet heads 36 to the paper P transferred by the belt transfer unit 33 to print images on the paper P. The print unit 35 is disposed above the belt transfer unit 33.

The inkjet heads 36Ka, 36C, 36M, 36Y and 36Kb eject black (K), cyan (C), magenta (M), yellow (Y) and black (K) ink droplets, respectively. The inkjet heads 36Ka, 36C, 36M, 36Y and 36Kb are disposed above the belt transfer unit 33 so as to be parallel to each other, and aligned along the transfer direction of the papers P (left-to-right direction). The inkjet heads 36Ka, 36C, 36M, 36Y and 36Kb are disposed in this order from upstream.

As shown in FIG. 3, each of the inkjet heads 36 has a nozzle row 37. The nozzle low includes plural nozzles 38. Each of the nozzles 38 ejects ink droplets. Each of the nozzles 38 is opened on a bottom surface of the inkjet head 36. The nozzles 38 are aligned along a direction perpendicular to the paper transfer direction (i.e. along a front-to-back direction).

It is understood from the above descriptions that the print unit 35 includes the five nozzle rows 37 that are aligned along the left-to-right direction so as to be parallel to each other, and are located on the inkjet heads 36, respectively. The most-upstream nozzle row 37 on the inkjet head 36Ka and the most-downstream nozzle row 37 on the inkjet head 36Kb selectively eject black ink. Black is a color having the lowest brightness among the four color (black, cyan, magenta and yellow) used for printing at the print unit 35, so that black has a high-visibility. Others of the nozzle rows 37 of the inkjet heads 36C, 36M and 36Y eject cyan ink, magenta ink and yellow ink, respectively.

The first paper ejector 4 ejects (feed out) the printed papers P to a post-processing unit (not shown in the drawings). In the post-processing unit, a post-processing such as paper-folding, bookbinding, stapling, punching may be done. The first paper ejector 4 includes a switching flap 41, a solenoid actuator 42, a pair of first ejection rollers 43, and a first ejection motor 44.

The switching flap 41 switches over the transfer path of the papers P between the normal path RC and the first ejection path RD1. The switching flap 41 is disposed at a branch point of the normal path RC and the first ejection path RD1. The first ejection path RC is a path that is branched form at a boundary between the paper-transfer/print unit 3 and the turn-around unit 5 and is extended toward the post-processing unit. The solenoid actuator 42 moves the switching flap 41 to switch over the transfer path of the papers P between the normal path RC and the first ejection path RD1.

The pair of first ejection rollers 43 ejects the paper P transferred from the belt transfer unit 33 toward the post-processing unit. The pair of first ejection rollers 43 is disposed downstream from the switching flap 41 along the first ejection path RD1. The first ejection motor 44 drives the pair of first ejection rollers 43.

The turn-around unit 5 further transfers the paper P transferred from the belt transfer unit 33 so as to turn it around from right to left. The turn-around unit 5 corresponds to a portion of the transfer unit defined in Claims. The turn-around unit 5 includes pairs of upward-transfer rollers 46, an upward-transfer motor 47, pairs of horizontal-transfer rollers 48, and a horizontal-transfer motor 49.

The pairs of upward-transfer rollers 46 further transfer the paper P transferred from the belt transfer unit 33 upward to the pairs of horizontal-transfer rollers 48. The pairs of upward-transfer rollers 46 are disposed along a middle section the normal path RC that extends curvedly upward. The upward-transfer motor 47 drives the pairs of upward-transfer rollers 46.

The pairs of horizontal-transfer rollers 48 further transfer the paper P transferred from the pairs of upward-transfer rollers 46 to the second paper ejector 6 or the switchback unit 7. The most-downstream pair of horizontal-transfer rollers 48 is disposed in an upstream segment of the switchback path RR. The remaining pairs of horizontal-transfer rollers 48 other than the most-downstream pair of horizontal-transfer rollers 48 are disposed in a horizontal downstream section of the normal path RC. The horizontal-transfer motor 49 drives the pairs of horizontal-transfer rollers 48.

The second paper ejector 6 ejects the printed papers P. The second paper ejector 6 includes a switching flap 51, a solenoid actuator 52, a pair of second ejection rollers 53, a second ejection motor 54, and a paper ejection tray 55.

The switching flap 51 switches over the transfer path of the papers P between the second ejection path RD2 and the switchback path RR. The switching flap 51 is disposed at a branch point of the second ejection path RD2 and the switchback path RR. The second ejection path RD2 is a path extending from a downstream end of the normal path RC toward the paper ejection tray 55. The solenoid actuator 52 moves the switching flap 51 to switch over the transfer path of the papers P between the second ejection path RD2 and the switchback path RR.

The pair of second ejection rollers 53 transferred the paper P introduced to the second ejection path RD2 by the switching flap 51 to eject the paper P onto the paper ejection tray 55. The pair of second ejection rollers 53 is disposed between the switching flap 51 and the paper ejection tray 55 on the second ejection path RD2. The second ejection motor 54 drives the pair of second ejection rollers 53.

On the paper ejection tray 55, the printed papers P ejected by the pair of second ejection rollers 53 are stacked. The paper ejection tray 55 has a tray shape protruded from the housing 11, and is provided so as to be sloped.

The switchback unit 7 turns over a paper P whose one side has been printed, and then feeds it toward the pair of registry rollers 31. The switchback unit 7 corresponds to a portion of the transfer unit defined in Claims. The switchback unit 7 includes a pair of switchback rollers 61, a switchback motor 62, a switchback space 63, a pair of refeed rollers 64, a refeed motor 65, and a switching gate 66.

The pair of switchback rollers 61 further feeds the paper P transferred by the pairs of horizontal-transfer rollers 48 of the turn-around section 5 into the switchback space 63 temporarily, and then feeds it back from the switchback space 63 to the pair of refeed rollers 64. The pair of switchback rollers 61 is disposed between the most-downstream pair of horizontal-transfer rollers 48 and a feed-in/out slot of the switchback space 63 on the switchback path RR. The switchback motor 62 drives the pair of switchback rollers 61.

The switchback space 63 is a space for storing the paper P transferred from the pair of switchback rollers 61 temporarily. The switchback space 63 is formed at a lower portion of the paper ejection tray 55. The feed-in/out slot through which the paper P is feed into the switchback space 63 and is feed out from the switchback space 63, is opened nearby the pair of switchback rollers 61.

The pair of refeed rollers 64 refeeds the paper P transferred from the pair of switchback rollers 61 to the pair of registry rollers 31. The pair of re-feed rollers 64 is disposed on the switchback path RR and between the pair of switchback rollers 61 and the pair of registry rollers 31. The refeed motor 65 drives the pair of refeed rollers 64.

The switching gate 66 guides the paper P transferred from the most-downstream pair of horizontal-transfer rollers 48 toward the pair of switchback rollers 61. In addition, the switching gate 66 also guides the paper P refeed out from the switchback space 63 by the pair of switchback rollers 61 toward the pair of refeed rollers 64. The switching gate 66 is disposed nearby a centroid of a triangle formed by the most-downstream pair of horizontal-transfer rollers 48, the pair of switchback rollers 61, and the pair of refeed rollers 64 when viewed from front (i.e. in FIG. 1).

The operation panel 8 receives user's input operations, and displays various entry screens. The operation panel 8 includes an input device 71 and a display 72. The input device 71 receives user's input operations, and then outputs command signals according to the input operations. The input device 71 is provided with various operational keys, a touchscreen and so on. The display 72 displays various entry screens. The display 72 is provided with an LCD and so on.

The image scanner 9 is an optical flatbed scanner provided with a document bed on which a document is set, a photosensitive element such as a CCD, a CIS or the like, a light source, lenses, a scanning mechanism, an automatic paper feeder (all are not shown in the drawings) and so on. The image sensor 9 optically scans images of a document, and then generates image data.

The controller 10 controls operations of the above components of the inkjet printer 1. The controller 10 is configured of a CPU, a RAM, a ROM, a HDD, and so on.

The controller 10 stores a table 81 (shown in FIG. 4) in which an ejection order of black ink is defined. The table 81 is a table that indicates the ejection order of black ink for each paper type. The ejection order of black ink indicates an ejection order of black ink relative to other colors. "First" indicates that a black ink is ejected first before ink ejections of other colors. "Last" indicates that a black ink is ejected last after ink ejections of other colors.

The controller 10 selectively uses the inkjet heads 36Ka and 36Kb for ejecting black ink (droplets). The controller 10 refers to the table 81 to select the inkjet head 36Ka or 36Kb according to a paper type (a type of a paper P). In a case of "first", the controller 10 selects the most-upstream inkjet head 36Ka for ejecting black ink. In a case of "last", the controller 10 selects the most-downstream inkjet head 36Kb for ejecting black ink.

In addition, the controller 10 also receives designation of an ejection order of black ink. Namely, the controller 10 also receives a setting in which it is specified whether black ink is ejected from the inkjet head 36Ka or 36Kb. This setting is specified based on a user's operation input through the input device 71 and/or based on print data sent from an external terminal (e.g. a personal computer from which a print command/data is sent) according to a user's operation input into the external terminal. If the setting of an ejection order of black ink is specified, the controller 10 selects the inkjet head 36Ka or 36Kb according to the setting to uses the selected one for printing.

Note that, in the present embodiment, selection/designation of the most-upstream inkjet head 36Ka or the most-downstream inkjet head 36Kb corresponds to selection/designation of the most-upstream nozzle row 37 or the most-downstream nozzle row 37 in the print unit 35.

Next, operations of the inkjet printer 1 will be described with reference to a flowchart shown in FIG. 5.

Processes in the flowchart shown in FIG. 5 is started when a print start command is generated. Specifically, in a case of printing a document scanned by the image scanner 9, the controller 10 starts the processes when it receives a signal of the print start command output from the input device 71 according to a user's operation. In addition, in a case of printing based on print data received from an external terminal, the controller 10 starts the processes when the controller 10 receives the print data.

First, the controller 10 determines whether or not an ejection order of black ink is already specified (step S1). Here, in the case of printing a document scanned by the image scanner 9, the controller 10 determines that an ejection order of black ink is specified, if a specifying operation (designation operation) is made through the input device 71 together with the print start command. In the case of printing based on print data received from an external terminal, the controller 10 determines based on print setting information included in the print data.

When it is determined that an ejection order of black ink is already specified (YES in step S1), the controller 10 carries out printing according to the specified ejection order (step S2). When printing is carried out, an unused paper P is fed out from one of the external paper feed tray 21 and the internal paper feed trays 23, and then the paper P is fed to the paper-transfer/print unit 3. In the paper-transfer/print unit 3, the paper P is transferred to the belt transfer unit 33 by the pair of registry rollers 31.

Then, the paper P is printed by ink droplets ejected from the print unit 35 while being transferred by the belt transfer unit 33. Here, if the ejection order of black ink is set to "first", the controller 10 selects the most-upstream inkjet head 36Ka for ejecting black ink (droplets). On the contrary, if the ejection order of black ink is set to "last", the controller 10 selects the most-downstream inkjet head 36Kb for ejecting black ink (droplets).

In a case of single-side printing and paper ejection to the post-processing unit, the paper P whose one side has been printed is introduced to the first ejection path RD1 from the normal path RC by the switching flap 41 of the first paper ejector 4. Then, the paper P is ejected to the post-processing unit by the pair of first ejection rollers 43.

In a case of single-side printing and paper ejection to the paper ejection tray 55 of the second paper ejector 6, the paper P whose one side has been printed is introduced to the turn-around unit 5 by the switching flap 41 of the first paper ejector 4. In the turn-around unit 5, the paper P is transferred to the switching flap 51 of the second paper ejector 6 by the pairs of upward-transfer rollers 46 and the pairs of horizontal-transfer rollers 48, and then is introduced to the second ejection path RD2 from the normal path RC by the switching flap 51. Then, the paper P is ejected onto the paper ejection tray 55 by the pair of second ejection rollers 53.

In a case of double-side printing, the paper P whose one side has been printed is introduced to the turn-around unit 5 by the switching flap 41 of the first paper ejector 4, and then further introduced to the switchback path RR from the normal path RC by the switching flap 51 of the second paper ejector 6. The paper P introduced to the switchback path RR is further introduced to the pair of switchback rollers 61 by the switching gate 66 in the switchback unit 7, and then is fed into the switchback space 63 by pair of switchback rollers 61.

Subsequently, the paper P is fed out from the switchback space 63 by the pair of switchback rollers 61. The paper P fed out from the switchback space 63 is introduced to the pair of refeed rollers 64 by the switching gate 66, and then is refed to the paper-transfer/print unit 3 by the pair of refeed rollers 64. In the paper-transfer/print unit 3, the paper P is transferred to the belt transfer unit 33 by the pair of registry rollers 31.

Since the paper P is already turned over by the switchback unit 7 so as to be its unprinted side turned up, the unprinted side of the paper P is printed by ink droplets ejected from the print unit 35 while being transferred by the belt transfer unit 33. Here, the controller 10 selects one of the inkjet heads 36Ka and 36Kb for ejecting black ink according to the specified ejection order.

In a case of double-side printing and paper ejection to the post-process unit, the paper P whose both sides have been printed is ejected to the post-process unit by the first paper ejector 4, similarly to the above-described case of single-side printing and paper ejection to the post-processing unit.

In a case of double-side printing and paper ejection to the paper ejection tray 55 of the second paper ejector 6, the paper P whose both sides have been printed is transferred to the second paper ejector 6 by the turn-around unit 5, and then ejected onto the paper ejection tray 55 of the second paper ejector 6, similarly to the above-described case of single-side printing and paper ejection to the paper ejection tray 55 of the second paper ejector 6.

When it is determined that an ejection order of black ink is not yet specified (NO in step S1), the controller 10 refers to the table 81 shown in FIG. 4 to determine whether or not a paper type of papers P to be used for printing is preset with the "first" ejection order of black ink (step S3). Here, in a case of printing of a document scanned by the image scanner 9, the controller 10 confirms a paper type based on a user's selection of a paper type input through the input device together with the print start command. In a case of printing based on print data sent from an external terminal, the controller 10 confirms a print type based on print setting information included in the print data.

When it is determined that the paper type is preset with the "first" ejection order (YES in step S3), the controller 10 carries out printing in the "first" ejection order of black ink (step S4). Specifically, the controller 10 selects the most-upstream inkjet head 36Ka for ejecting black ink to carry out printing.

When it is determined that the paper type is preset with the "last" ejection order (NO in step S3), the controller 10 carries out printing in the "last" ejection order of black ink (step S5). Specifically, the controller 10 selects the most-downstream inkjet head 36Kb for ejecting black ink to carry out printing.

As described above, the inkjet printer 1 carries out printing in the "first" or "last" ejection order of black ink. Here, it is generally known in the art that, when one ink are ejected on a paper and then another ink is ejected on the paper after a time duration, the one ink ejected first dominantly occupies a surface (and a superficial zone) of the paper. In addition, an ink permeable depth varies according to a paper type.

Figure 6A:
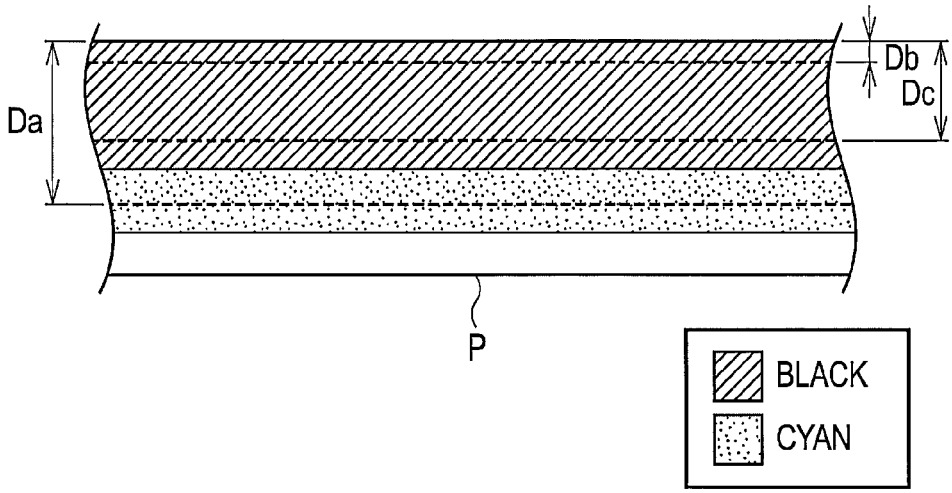
FIG. 6A is a schematic cross-sectional view showing ink permeability when black ink is ejected first on a plain paper.
Figure 6B:
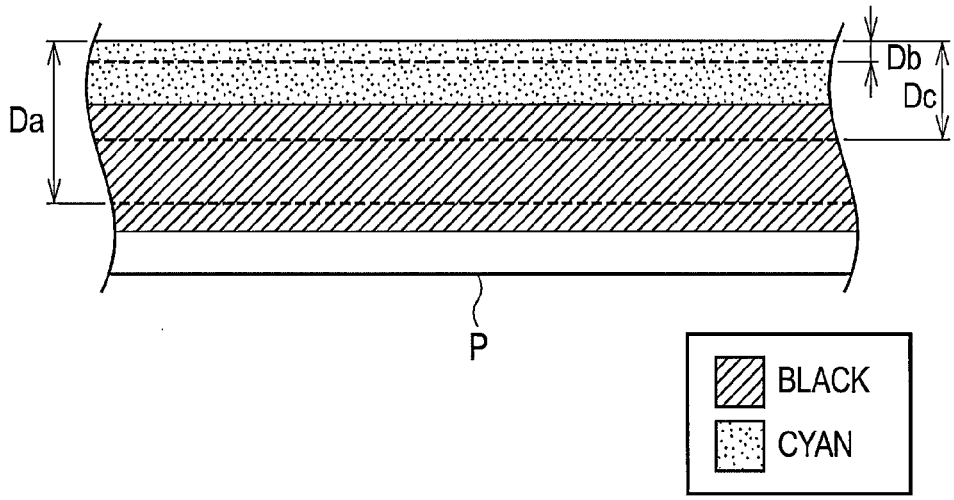
FIG. 6B is a schematic cross-sectional view showing ink permeability when black ink is ejected last on a plain paper.

For example, when a composite black image is printed on a plain paper P with black ink and cyan ink, its ink permeability is shown in FIG. 6A or 6B. FIG. 6A shows ink permeability in a "first" ejection order of black ink, and FIG. 6B shows ink permeability in a "last" ejection order of black ink. In addition, when a composite black image is printed on a matte paper P with black ink and cyan ink, its ink permeability is shown in FIG. 7A or 7B. FIG. 7A shows ink permeability in a "first" ejection order of black ink, and FIG. 7B shows ink permeability in a "last" ejection order of black ink.

In a case of the "first" ejection order of black ink, as shown in FIGS. 6A and 7A, black ink occupies a surface (and a superficial zone) of a paper P, and cyan ink permeates beneath the black ink. On the contrary, in a case of the "last" ejection order of black ink, as shown in FIGS. 6B and 7B, cyan ink occupies a surface (and a superficial zone) of a paper P, and black ink permeates beneath the cyan ink. In addition, ink permeates more easily into a plain paper P than into a matte paper P, so that depths of the ink permeation become shallower with a matter paper P as shown in FIGS. 7A and 7B than with a plain paper P as shown in FIGS. 6A and 6B.

Here, ink that permeates into a certain depth range from a surface of a paper P preferentially affects density of a printed image. A permeation range of the ink that preferentially affects density of a printed image is denoted as a depth range Da from a surface of a paper P.

With respect to a plain paper, as shown in FIGS. 6A and 6B, ink permeates deeper than the depth Da. In a case of the "last" ejection of black ink, as shown in FIG. 6B, the black ink permeates beneath cyan ink into a deeper depth range than the depth range Da that doesn't affect density of a printed image. On the other hand, in a case of the "first" ejection of black ink, as shown in FIG. 6A, the black ink occupies a surface (and a superficial zone) of a paper P and its permeation depth is shallower than the deepest level of the depth range Da that doesn't affect density of a printed image. Therefore, with respect to a plain paper, a black color tone becomes greater by the "first" ejection order of black ink than by the "last" ejection order of black ink, so that darker black can be expressed by the "first" ejection order of black ink.

On the other hand, with respect to a matte paper, as shown in FIGS. 7A and 7B, ink stays in a shallower range than the deepest level of the depth range Da. Therefore, with respect to a matte paper, density difference of printed images is small between the "first" ejection order of black ink shown in FIG. 7A and the "last" ejection order of black ink shown in FIG. 7B.

In addition, ink staying on a surface (and a superficial zone) of a paper P causes smears by rubbing, such as smears by finger rubbing and so on. An ink staying range that affects such smears caused by rubbing is denoted as a depth range Db from a surface of a paper P. The depth range Db is narrower (shallower) than the above-mentioned depth range Da.

In a case of the "last" ejection order of black ink, cyan ink stays in the depth range Db as shown in FIGS. 6B and 7B. On the other hand, in a case of the "first" ejection order of black ink, black ink stays in the depth range Db as shown in FIGS. 6A and 7A. Therefore, smears caused by rubbing may become darker in the case of "first" ejection order of black ink than in the case of "last" ejection order of black ink, and thereby the smears in the case of the "first" ejection order is subject to become more distinct.

Since ink permeates more hardly into a matte paper than into a plain paper as described above, more colorants (e.g. pigments, dyes) of ink stays near a surface of a paper P in a matte paper than in a plain paper. Therefore, smears caused by rubbing may occur more easily on a matte paper than on a plain paper. In addition, difference of degrees of smears caused by rubbing between the "first" ejection order and the "last" ejection order becomes larger in a matte paper than in a plain paper. Since relatively fewer ink colorants stay in the depth range Db in a plain paper, a degree of smears caused by rubbing is small even in a "first" ejection order of black ink and difference of degrees of smears caused by rubbing between the "first" ejection order and the "last" ejection order is also small.

A test result for checking print density and smears caused by rubbing is presented in a table shown in FIG. 8. In the test, print density and smears caused by rubbing are checked by printing the above-mentioned composite black image with black ink and cyan ink by the "first/last" ejection order of black ink. The print density is checked by measuring an OD value. In addition, a degree of smears caused by rubbing is checked by visual evaluation, and "A" indicates that a degree of smears is smallest (best), and "D" indicates that a degree of smears is largest (worst).

Figure 9A:
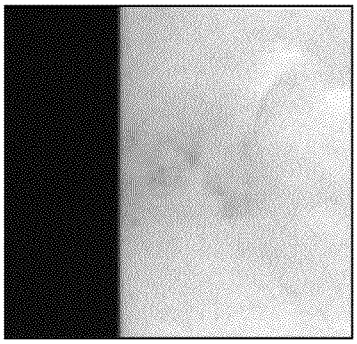
FIG. 9A is an image showing a smears caused by rubbing when black ink is ejected first onto a plain paper.
Figure 9B:
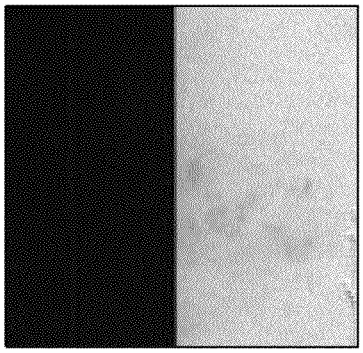
FIG. 9B is an image showing a smears caused by rubbing when black ink is ejected last onto a plain paper.
Figure 10A:
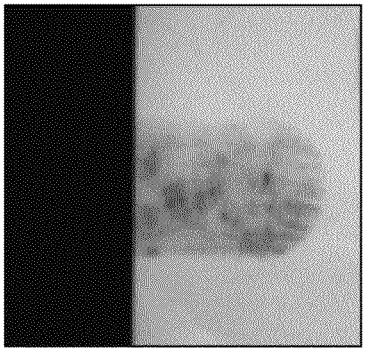
FIG. 10A is an image showing a smears caused by rubbing when black ink is ejected first onto a matte paper.
Figure 10B:
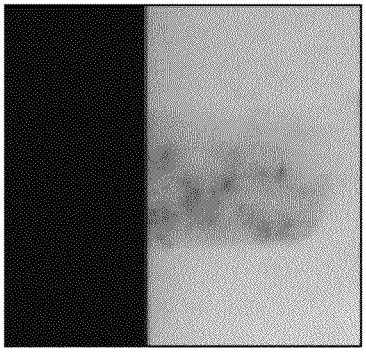
FIG. 10B is an image showing a smears caused by rubbing when black ink is ejected last onto a matte paper.

In the test, smears caused by rubbing are reproduced by rubbing a printed image from a blank area on its outside several times by using a crock meter. FIG. 9A shows smears caused by rubbing on a plain paper in the "first" ejection order of black ink FIG. 9B shows smears caused by rubbing on a plain paper in the "last" ejection order of black ink. FIG. 10A shows smears caused by rubbing on a matte paper in the "first" ejection order of black ink. FIG. 10B shows smears caused by rubbing on a matte paper in the "last" ejection order of black ink. In FIGS. 9A to 10B, a black area shown on the left is the composite black image, and the blank area is on the right of the composite black image.

As shown in the table shown in FIG. 8, with respect to a plain paper, the "first" ejection order of black ink brought a higher density level (larger OD value) than the "last" ejection order. On the other hand, with respect to a matte paper, the "first" ejection order and the "last" ejection order brought almost the same density.

As shown in the table shown in FIG. 8, and FIGS. 9A and 9B, with respect to a plain paper, degrees of smears caused by rubbing are relatively small, and difference of degrees of smears caused by rubbing between the "first" ejection order and the "last" ejection order is small.

On the other hand, as shown in the table shown in FIG. 8, and FIGS. 10A and 10B, with respect to a matte paper, degrees of smears caused by rubbing are larger than those with respect to a plain paper, and difference of degrees of smears caused by rubbing between the "first" ejection order and the "last" ejection order is large.

As described above, with respect to a plain paper, the "first" ejection order of black ink brings a higher density level of a printed image than the "last" ejection order and thereby good print quality can be achieved, and a degree of smears caused by rubbing is hardly affected by the ejection order of black ink. On the other hand, with respect to a matte paper, the "last" ejection order of black ink brings a smaller degree of smears caused by rubbing than the "first" ejection order, and a density level of a printed image is hardly affected by the ejection order of black ink.

Therefore, according to the inkjet printer 1, printing on a plain paper is done in the "first" ejection order of black ink, and printing on a matte paper is done in the "last" ejection order of black ink, as preset in the table 81 shown in FIG. 4. Namely, in the inkjet printer 1, the ejection order of black ink is preset according to a paper type in order to restrict smears caused by rubbing while keeping good print quality.

Note that, although the ink staying range that affects smears caused by rubbing is denoted as the depth range Db in the above description, the ink staying range that affects smears caused by rubbing may become deeper depending on a pressure applied to a surface of a paper P.

For example, depending on a paper type, a high pressure may be applied to a printed paper P while the paper P is ejected to the post-processing unit from the first paper ejector 4 of the inkjet printer 1. Specifically, if the post-processing unit is a paper folding unit for folding the paper P that has been printed by the inkjet printer 1, a high pressure is applied to the paper P by rollers provided for paper folding. In such a case, the ink staying range that affects smears caused by rubbing becomes a wider (deeper) depth range Dc from a surface of a paper P as shown in FIGS. 6A to 7B than the above-described depth range Db.

A degree of smears caused by rubbing in the case of the depth range Db is small as described above, but a degree of smears caused by rubbing in the case of the depth range Dc may become larger (worse) even with respect to a plain paper.

In addition, with respect to a plain paper, the depth range Dc is occupied by black ink in a case of the "first" ejection order of black ink as shown in FIG. 6A, but cyan ink stays near a surface of a paper P in a case of the "last" ejection of black ink as shown in FIG. 6B. Therefore, a degree of smears caused by rubbing in the case of "first" ejection order of black ink becomes larger (worse) than that in the case of the "last" ejection order of black ink.

With respect to a matte paper, in the case of the depth range Db as described above, difference of degrees of smears caused by rubbing is large between the "first" ejection order of black ink and the "last" ejection order of black ink, and a degree of smears caused by rubbing in a case of the "last" ejection order is smaller than that in a case of the "first" ejection order. This tendency is the same as in a case of the depth range Dc.

Therefore, if printing is done on a plain paper in the "first" ejection order of black ink according to the table 81 shown in FIG. 4, a degree of smears caused by rubbing may become larger (worse), for example, in a case where a high pressure is applied to a paper P in the post-processing unit.

In order to avoid such a case where a degree of smears caused by rubbing may become larger with respect to a plain paper in the case of the depth range Dc (i.e. a high pressure is applied to a paper P), it made possible to accept a user's designation of an ejection order of black ink in the inkjet printer 1. For example, in a case where a printed plain paper is to be processed by a post-processing, a user can select a "last" ejection order of black ink according to a kind of the post-processing by using the input device 71 when he/she wants to put a higher priority on restriction of smears caused by rubbing than on print quality.

According to the inkjet printer 1 in the present embodiment, when an ejection order of black ink is not yet specified, the controller 10 determines the ejection order of black ink based on a paper type. Then, the controller 10 selects, based on the determined ejection order of black ink, the most-upstream inkjet head 36Ka or the most-downstream inkjet head 36Kb for ejecting black ink (droplets). Therefore, the inkjet printer 1 can carry out printing in an adequate ejecting order of black ink for restricting smears caused by rubbing while keeping good print quality. As a result, it becomes possible to restrict contaminations on a printed media while also restricting degradation of print quality.

According to the inkjet printer 1 in the present embodiment, the controller 10 can accept a designation of an ejection order of black ink for printing. The designation of an ejection order of black ink corresponds to a selection of the inkjet head 36Ka or 36Kb as an inkjet head for ejecting black ink. When the designation of an ejection order is specified, the controller 10 selects the most-upstream inkjet head 36Ka or the most-downstream inkjet head 36Kb as an inkjet head for ejecting black ink according to the specified ejection order of black ink. Therefore, the inkjet printer 1 can respond adequately for a user's request for the ejection order of black ink.

Note that, in a case of the "last" ejection order of black ink, the controller 10 may control the paper-transfer/print unit 3 so that an ink ejection interval between an ink ejection timing of black and an ink ejection timing of other colors is made longer. Specifically, the controller 10 makes a transfer speed of a paper P slower in a case of the "last" ejection order of black ink than in a case of the "first" ejection order of black ink. In addition, the controller 10 controls timings of ink ejections from the inkjet heads 36 of the print unit 35 according to the above control of the transfer speed. According to this control, an interval between an ejection timing from the inkjet heads 36C, 36M and 36Y and an ejection timing from the inkjet head 36Kb (i.e. in a case of the "last" ejection order) can be made longer than an interval between an ejection timing from the inkjet heads 36C, 36M and 36Y and an ejection timing from the inkjet head 36Ka (i.e. in a case of the "first" ejection order).

Here, in a case where ink droplets of plural colors are ejected onto an identical landing point, the longer intervals of ejection timings of the plural colors are, the stronger a color tone of ink ejected later becomes. This reason will be described next.

When ink droplets of plural colors are ejected onto a paper in a short time, an amount of solvents that permeate into an inside of the paper becomes large and thereby ink colorants permeate deeply from a surface of the paper. On the contrary, when ejection intervals of ink are made longer, an amount of solvents ejected onto a paper by one shot becomes small and thereby a permeable depth of solvents and colorants becomes shallower. As a result, a color tone of ink ejected later becomes stronger.

Figure 11:
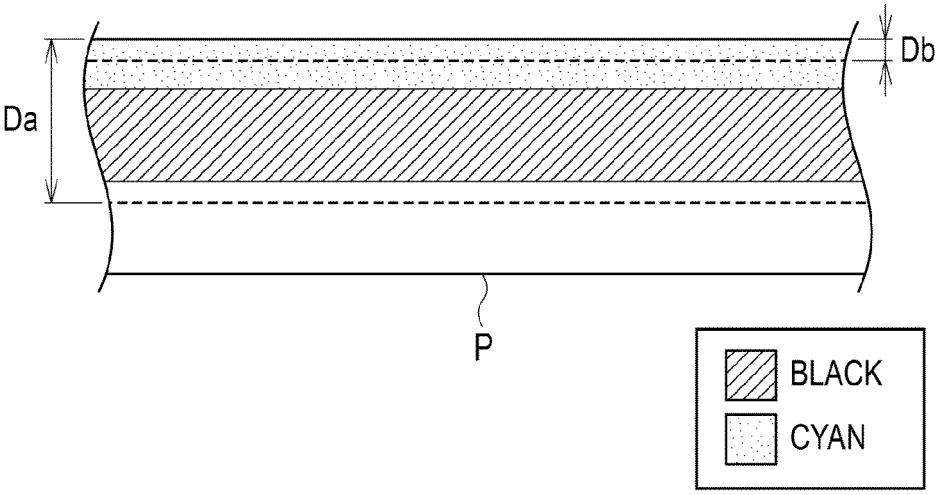
FIG. 11 is a schematic cross-sectional view showing ink permeation when black ink is ejected last on a plain paper but a duration time between cyan ink ejection and black ink ejection is made longer than that in a case shown in FIG. 6B.

In a case where a composite black image is printed on a plain paper P with black ink and cyan ink in a "last" ejection order of black ink similarly to the case shown in FIG. 6B, FIG. 11 shows ink permeability when an ink ejection interval of the two colors is made longer than that in the case shown in FIG. 6B. Although black ink permeates to the deepest level of the depth range Da in the case shown in FIG. 6B (a "last" ejection order of black ink with a short interval), black ink doesn't permeate to the deepest level of the depth range Da in the case shown in FIG. 11 (a "last" ejection order of black ink with a long interval). Therefore, a black color tone becomes greater in the case shown in FIG. 11 than in the case shown in FIG. 6B, so that deeper black can be expressed.

In this manner, print quality in a case of a "last" ejection of black ink can be improved by making an interval between an ink ejection timing of black and an ink ejection timing of other colors longer than that in a case of the "first" ejection order of black ink. Here, the interval between an ink ejection timing of black and an ink ejection timing of other colors may be set to a value experimentally determined, for example.

In the above description, the interval between an ink ejection timing of black and an ink ejection timing of other colors is made longer by making the transfer speed of a paper P slower. However, the interval may be made slower by circularly transferring a paper P along the normal path RC and the switchback path RR.

Specifically, the controller 10 circularly transfers a paper P along the normal path RC and the switchback path RR twice after ink ejections of colors other than black from the print unit 35 onto a paper P transferred by the belt transfer unit 33. Then, the controller 10 ejects black ink (droplets) from the inkjet head 36Kb onto a faced-up surface of the paper P in the second transfer.

In this case, the controller 10 may adjust the interval between an ink ejection timing of black and an ink ejection timing of other colors by adjusting time for holding the paper P in the switchback space 63 of the switchback unit 7.

In addition, the inkjet heads 36 may be arranged so that a distance between the most-downstream inkjet head 36Kb and the inkjet head 36Y adjacently located upstream from the inkjet head 36Kb is made longer than any of distances between other two inkjet heads 36. According to this configuration, it can be possible to make the interval (between an ink ejection timing of black and an ink ejection timing of other colors) in a "last" ejection order of black ink longer than that in a case of the "first" ejection order of black ink, independently from a control of a transfer speed of a papers P.

In the above embodiment, designation of an ejection order of black ink is accepted, but it may be omitted.

In the above embodiment, the print unit 35 is provided with five rows of the nozzle rows 37, and the most-upstream and most-downstream nozzle rows 37 eject black ink and other three of the nozzle rows 37 eject cyan, magenta and yellow ink, respectively. However, combination of the number of nozzle rows and/or ink colors is not limited to this configuration. The print unit 35 may have three or more of nozzle rows and its most-upstream nozzle row and its most-downstream nozzle row are capable of ejecting ink whose color has the lowest brightness among colors of ink to be used for printing (other nozzle rows eject ink of other colors).

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of a priority under 35 U.S.C. §119 to Japanese Patent Application No. 2014-26394, filed on Feb. 14, 2014, the entire content of which is incorporated herein by reference.

What is claimed is:

1. An inkjet printer comprising:

a transfer unit that transfers a paper;

a print unit that has three or more nozzle rows aligned along a transfer direction of the paper, a most-upstream nozzle row and a most-downstream nozzle row of the three or more nozzle rows being capable of ejecting a pigment ink whose color has a lowest brightness among colors of pigment inks to be used for printing and one or more remaining nozzle rows except the most-upstream nozzle row and the most-downstream nozzle row ejecting pigment inks whose colors do not have the lowest brightness; and a controller that ejects pigment inks on the paper by controlling the print unit while transferring the paper by controlling the transfer unit, wherein the controller selects any one of the most-upstream nozzle row and the most-downstream nozzle row as a selected nozzle row for ejecting the pigment ink whose color has the lowest brightness according to a type of the paper, and controls the print unit to eject pigment inks from the selected nozzle row and the remaining nozzle rows, onto the paper being transferred along the transferred direction, sequentially from upstream toward downstream of the selected nozzle row and the remaining nozzle rows along the transfer direction.

2. The inkjet printer according to claim 1, wherein, when the controller selects the most-upstream nozzle row as the nozzle row for ejecting the pigment ink whose color has the lowest brightness, the controller controls the print unit to eject the pigment ink whose color has the lowest brightness first among pigment inks to be ejected from the nozzle rows except the most-downstream nozzle row, and the controller controls the print unit not to eject a pigment ink from the most-downstream nozzle row.

3. The inkjet printer according to claim 1, wherein, when the controller selects the most-downstream nozzle row as the nozzle row for ejecting the pigment ink whose color has the lowest brightness, the controller controls the print unit to eject the pigment ink whose color has the lowest brightness last among pigment inks to be ejected from the nozzle row except the most-upstream nozzle row, and the controller controls the print unit not to eject a pigment ink from the most-upstream nozzle row.

* * * * *